United States Patent [19]

Kemmerer

[11] 3,999,710

[45] Dec. 28, 1976

[54] AUXILIARY HEATING EQUIPMENT

[76] Inventor: Marlin Kemmerer, 2511 S. Lloyd St., Philadelphia, Pa. 19142

[22] Filed: Apr. 7, 1975

[21] Appl. No.: 566,038

[52] U.S. Cl. ..... 237/53; 237/55; 237/69; 236/16; 126/285 R

[51] Int. Cl.[2] ..... F24D 5/00

[58] Field of Search ..... 237/69, 53, 50, 55; 236/16; 126/285, 290; 52/169

[56] References Cited

UNITED STATES PATENTS

| | | | |
|---|---|---|---|
| 569,186 | 10/1896 | Fisher | 236/16 |
| 1,728,053 | 9/1929 | Gill | 237/53 |
| 1,746,231 | 2/1930 | Barker | 237/69 |
| 1,848,653 | 3/1932 | Persons | 236/16 |
| 1,872,213 | 8/1932 | Anderson | 126/285 R |
| 2,077,599 | 4/1937 | Wales | 237/55 |
| 2,342,925 | 2/1944 | Bensten et al. | 126/285 R |
| 3,426,487 | 2/1969 | Forte | 52/169 |

FOREIGN PATENTS OR APPLICATIONS

| | | | |
|---|---|---|---|
| 1,259,576 | 3/1961 | France | 237/50 |
| 33,693 | 8/1963 | Poland | 237/53 |
| 266,836 | 3/1927 | United Kingdom | 237/69 |

*Primary Examiner*—John J. Camby
*Assistant Examiner*—Henry C. Yuen
*Attorney, Agent, or Firm*—Robert K. Youtie

[57] ABSTRACT

In a building heating system having a furnace, the instant invention incorporates a furnace enclosure for spacedly enclosing the furnace, an inlet air duct for conducting fresh air to the enclosure space for supporting combustion in the furnace, a combustion products outlet duct extending from the furnace, radiant heating duct means extending from the combustion products duct in radiant heat exchange relation with building space, and flue means communicating with the radiant heating duct for exhausting flue gas.

8 Claims, 5 Drawing Figures

FIG. 1
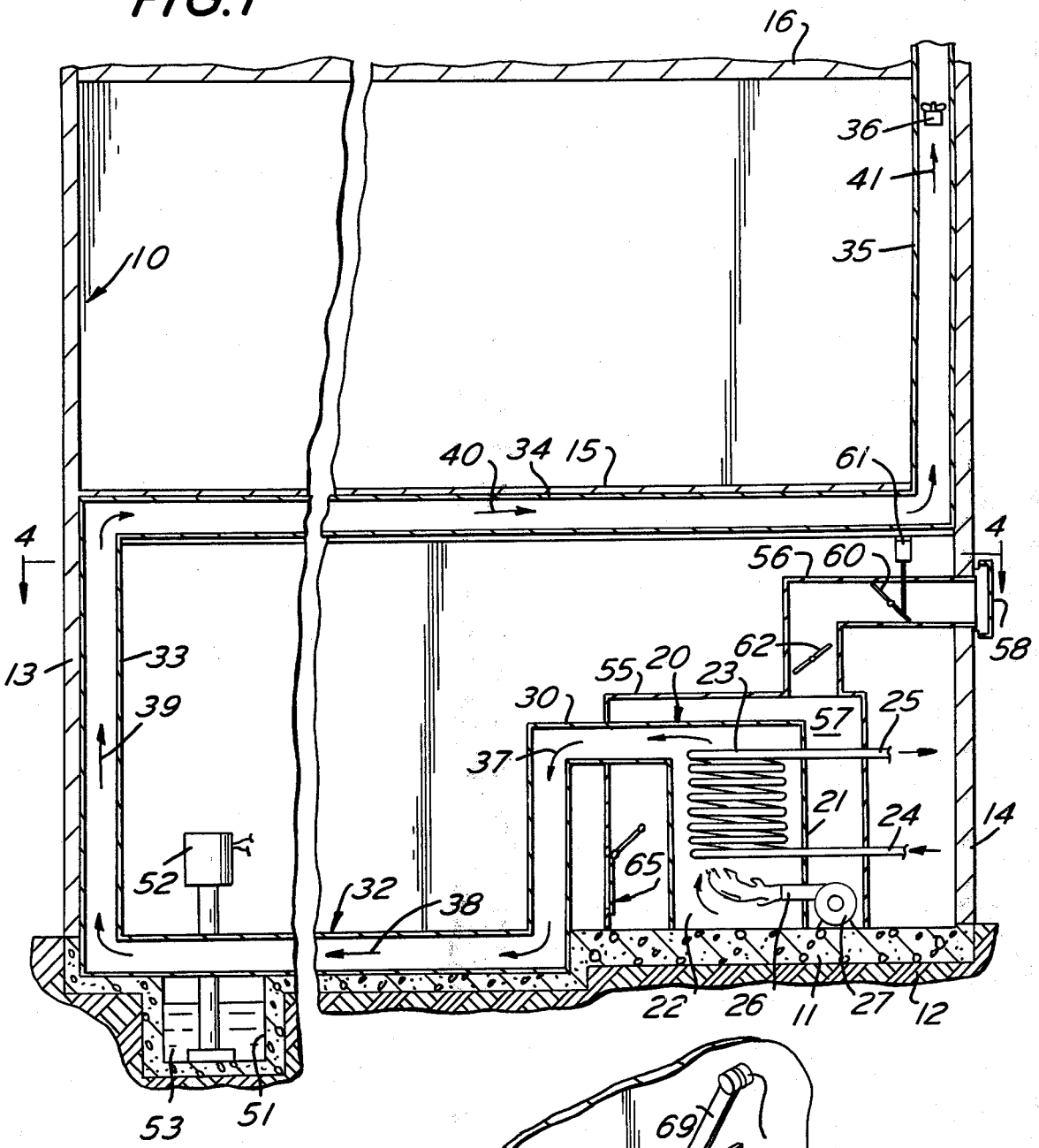
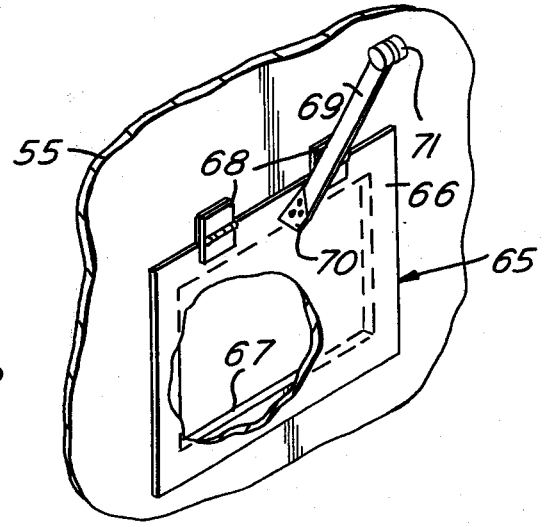
FIG. 3

AUXILIARY HEATING EQUIPMENT

BACKGROUND OF THE INVENTION

The auxiliary heating equipment of the present invention may be employed in conjunction with heating systems of different types, including hot water, hot air and steam heating systems. While the embodiment illustrated and described herein is specific to a hot water heating system, it is appreciated that this is shown for purposes of illustration only and without limiting intent, but could equally well have been shown in conjunction with another conventional type of heating system.

As is well known to those versed in the field of heating, high stack temperatures represent substantial loss of heat to the atmosphere, at considerable cost to the user. While many heating systems are represented as having stack temperatures of 470°–570° Fahrenheit, in practice it has been found not unusual for stack temperatures to be about 830° Fahrenheit.

Also, prior art heating systems usually utilized inside air for combustion, which required a substantial flow of combustion air usually through leakage, thereby preventing draft-free weather stripping.

Also, conventional heating systems usually required relatively high combustion or burner temperatures in order to obtain the required amount of heat from the relatively small quantity of fast moving air. This procedure was, of course, thermally inefficient, not only by stack losses, but also by excessive furnace radiation and conduction.

SUMMARY OF THE INVENTION

It is an important object of the present invention to provide auxiliary heating equipment of the type described which very substantially reduces the actual stack gas temperatures to a maximum of 200° Fahrenheit, and generally less than 150° Fahrenheit.

It is a further object of the present invention to provide auxiliary heating equipment of the type described which supplied outside air for combustion to avoid the waste of previously heating inside air, permitting of tighter weather stripping for reducing drafts, and positively controlling the supply of outside air to avoid or minimize a cooling effect on the internal heater surfaces during off periods.

It is a further object of the present invention to spacedly enclose a furnace or heater to envelop the latter in a supply of combustion air to provide a high air-fuel ratio in the furnace for most efficient combustion and producing an increased volume of combustion products for heat exchange with the living area.

It is still a further object of the present invention to provide highly improved auxiliary equipment for use with a heating system which is extremely simple in construction, durable and safe in operation, highly effective in saving fuel, and reliable throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial sectional elevational view broken away to show a building construction incorporating a heating system and the auxiliary equipment of the present invention.

FIG. 3 is a perspective view, partly broken away, showing a normally-closed interior air inlet.

DESCRIPTION OF THE PREFERRED EMBODIMENT

Figure 4:
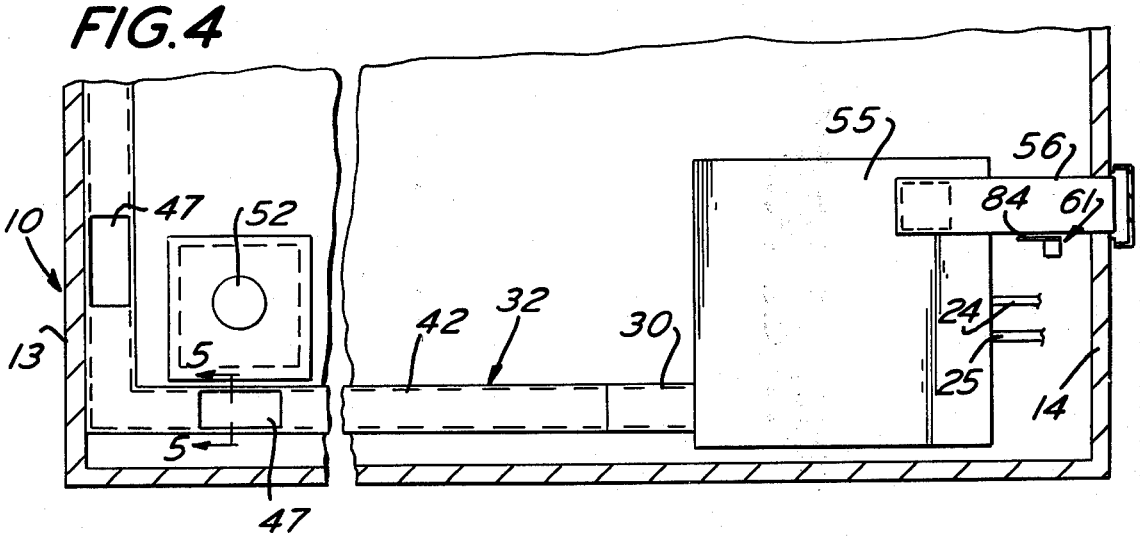
FIG. 4 is a partial horizontal sectional view taken generally along the line 4—4 of FIG. 1.

Referring now more particularly to the drawings, and specifically to FIGS. 1 and 4 thereof, a building structure is there generally designated 10, and may be a dwelling, single or multiple, or commercial building, or other. In the illustrated embodiment the building 10 includes a bottom wall or floor of slab construction 11, resting on the ground 12. Upstanding from the bottom wall or slab 11 are external building walls 13 and 14, which may extend completely around the slab. An intermediate horizontal wall or first floor 15 extends between the side walls 13 and 14, and an upper intermediate wall or floor 16 extends between upper regions of the side walls.

The slab 11 and enclosing side walls 13 and 14 may combine to define a basement, first floor utility room, or the like, and a furnace or heater 20 is mounted on the floor 11. The furnace or heater 20 may be essentially conventional, and for purposes of illustration and without limiting intent, is shown as being a hot water furnace including a casing 21 surrounding a combustion chamber 22 wherein is located a heating coil 23, say for hot water, having a water inlet 24 and a water outlet 25. A burner, as at 26, say for burning gas, oil or other suitable fuel, includes a fan or blower 27 exteriorly of the casing 21 and enters into the casing to terminate in the combustion chamber 22. The blower or fan 27 may serve to move combustion air from exteriorly of the casing 21 into the combustion chamber 22.

Outlet duct means, as at 30, communicates with an upper region of the interior of casing 21 for removing combustion products from the furnace.

Extending from and communicating with the combustion products outlet duct 30, remote from the furnace 20, is suitable radiation duct means 32. The radiation duct means 32 may be recessed into the slab floor 11, having its upper surface generally flush with the latter and extending along the perimeter of the floor adjacent to the building side walls 13 and 14 for a desired length. From the floor radiation duct means 32, there extends an intermediate outlet duct 33 generally vertically upwardly to the floor 15, where an additional length of radiant heat duct means 34 may extend horizontally within the latter floor, say about the perimeter thereof for further conducting the combustion products exiting from the furnace or heater 20. Extending from the discharge end of radiant heat duct means 34 is a flue or outlet duct 35 which may discharge through a chimney (not shown) to the atmosphere. If desired, there may be gas-moving means, such as an exhaust fan 36 located in the flue means 35. Thus, it will now be appreciated that the combustion products of furnace 20 pass in the direction of arrows 37 through the combustion products outlet duct 30, thence in the direction of arrows 38 through radiant heating duct means 32, from which the combustion products pass in the direction of arrow 39 through duct means 33, and thence horizontally through radiant heating duct means 34 in the direction of arrow 40, and finally through flue means 35 in the direction of arrow 41 for discharge to the atmosphere.

Figure 5:
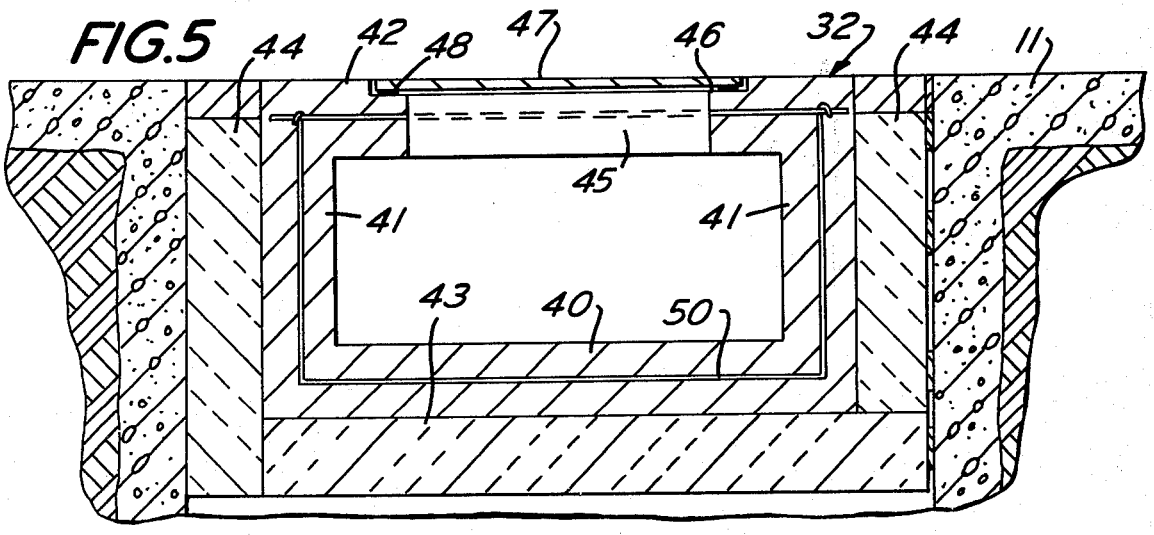
FIG. 5 is a partial sectional view taken generally along the line 5—5 of FIG. 4, enlarged for clarity.

In the slab floor 11, the duct means 32 is advantageously of a concrete construction, see FIG. 5, including a concrete bottom wall 40, concrete side walls 41 upstanding from opposite sides of the bottom wall into and therewith, and a concrete top wall 42 extending between upper regions of the side wall spaced over the bottom wall 40. The radiant heating duct means 32 may be surrounded on its bottom and sides by suitable insulation, as at 43 beneath bottom wall 40, and 44 adjacent to and outward of side walls 41. At spaced locations along the top wall 42, there may be provided through access or inspection openings 45, preferably each surrounded on its upper side with a shoulder 46 removably receiving a closure plate or cover 47 resting on suitable gasket means 48. Advantageously, the integral concrete duct structure of walls 40, 41 and 42 may be suitably reinforced, as by metal reinforcing means 50.

In use of the instant equipment with a slab floor, it is preferred to employ a drainage well or sump 51, having associated therewith a suitable sump pump 52, to maintain a level of collected water 53 well below the duct 32 to avoid any cooling or flooding of the duct.

In addition, there is provided in spaced relation about and enclosing the casing 21 of furnace or heater 20, a jacket or enclosure 55. The jacket or enclosure 55 spacedly encloses the casing 21, and the jacket need not be completely air-tight, but substantial air-tightness is desirable. The blower or fan 27 of burner 26 is advantageously located within the enclosure 55 for receiving air from the space between the enclosure and casing 21.

An inlet air duct 56 extends from communication at one end with the space 57 between the enclosure 55 and casing 21, and communication at its other end through the outside wall 14 to the exterior of the building 10, as by a baffle or protective member 58. Thus, outside air may pass from exteriorly of the building 10 inwardly through inlet air duct 56 to jacket space 57 and thence through burner 26 for combustion in chamber 22.

Located in the inlet air duct 56 is a inlet air valve 60 openable to pass outside air into the space 57, and closable to prevent such air passage. Operating means 61 is associated with inlet valve 60 for automatically opening and closing the latter, while an infinitely adjustable valve or damper 62 is advantageously mounted in the inlet air duct 56 between the valve 60 and fan or blower 27. The damper 62 may serve to restrict inlet air movement through duct 56 even when valve 60 is open, to thereby lower the pressure in chamber 57.

There is also provided in one wall of enclosure 55 a safety air inlet 65 for opening the jacket space 57 between enclosure 55 and casing 21 to the interior of building 10. The safety air inlet valve 65 may be a one-way valve responsive to pressure differential, so that upon any failure of the air supply through duct 56, say by clogging of the latter or for other reasons, the fan or blower 27 creates a pressure differential sufficient to open valve 65 and admit air for passage to the combustion chamber 22.

The safety air inlet valve 65 is shown in detail in FIG. 3, as including a generally flat valve member or plate 66 on the inner side of and in covering relation with respect to a wall opening 67 of the enclosure 55. Suitable hinge means 68 swingably suspend the plate 66 in its overlying, closing relation with the wall opening 67. Extending obliquely upwardly and away from an upper region of the plate 66 is a actuating arm or lever 69 which has one end fixed, as by securement means 70, to the plate 66, and is provided on its outer, distal or free end with a suitably calibrated weight 71. Thus, the weight 71 by its lever arm about the hinge means 68, must be overcome by pressure differential, as described hereinbefore, to open the safety air inlet valve 65.

Figure 2:
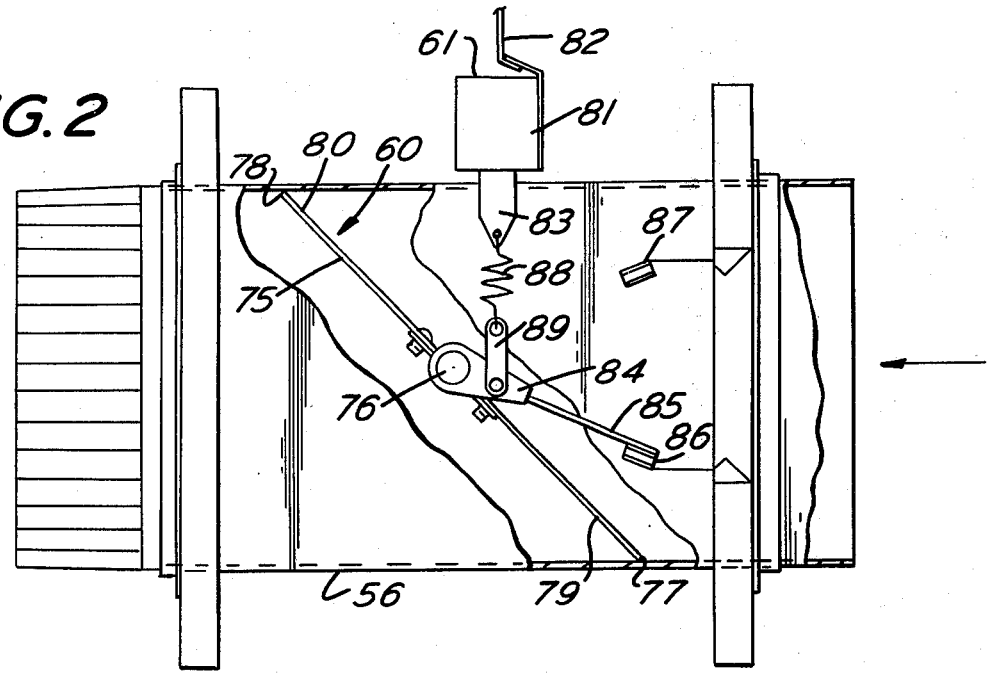
FIG. 2 is an elevational view, partly in section, showing an air inlet valve of the present invention.

The air inlet valve 60 is best seen in FIG. 2. It will there be seen that the valve 60 includes a generally flat valve member or plate 75 having a configuration such as to extend completely across and close the interior of inlet air duct 56 when in an oblique relation with respect to the air duct. More specifically, the valve member or plate 75 closes the air duct 56 when disposed at an angle of 45° with respect to the longitudinal direction of the air duct. A generally horizontally disposed pivot 76 carries the valve plate 75, to mount the valve plate for movement between its closed oblique position, shown in FIG. 2, and an open position extending longitudinally of the duct 56. The pivot 76 has its axis extending horizontally and is secured to the valve plate 75 at a location spaced further from the upstream end 77 of the plate than the downstream plate end 78. Thus, the axis of the pivot 76 may be considered as subdividing the plate 75 into a relatively large upstream region 79 and a relatively small downstream region 80. By this construction and arrangement the valve member 75 will gravitationally swing to its closed position, the upstream region 79 being downward and the downstream region 80 being upward. Further, aerodynamic forces, such as pressure by outside air or vacuum by blower 27 will serve to maintain the valve member 75 in its closed position.

Valve operating means 61 may include a generally vertically disposed solenoid 81 carried by hanger 82 and having a plunger 83 depending along an axis upstream of the pivot axis of pin 76. An arm 84 may extend from pivot pin 76, exteriorly of the duct 56, and has its free end 85 swingable together with the valve member 75 between limiting positions engaging stops 86 and 87. That is, with the arm 84 having its free end 85 in the limiting position engaging stop 86, the valve plate 75 is in its closed position, and upon 45° rotation, counterclockwise as seen in FIG. 2, the free arm end 85 will be in limiting abutting engagement with stop 87 and the valve plate 75 in its open, horizontal position, longitudinally of the duct 56.

Connection means, such as a resilient tension member 88 and a link 89 may connect the plunger 83 to the arm 84. Thus, upon downward extension of plunger 83 the valve plate 75 is released for gravitational downward movement to its closed position, as illustrated. Upon upward shifting movement of plunger 83, the arm 84 as through connection spring 88 and link 89 swings upward to move valve plate 75 into its open longitudinal position.

Suitable electrical interconnection is made between fan or blower 27 and inlet valve operating means 61, so that the inlet valve 60 is open when the fan is working.

Further, the valve 60 closes when the fan 27 is not working, so that escape or cooling of heated air is avoided or minimized. Of course, the blower 27 and inlet air valve operating means 61 are advantageously electrically connected to thermostatic means for automatic operation; and further, a float switch may be located in the sump 51 to disable the thermostat circuit in the event of an excessively elevated water level.

From the foregoing it is seen that the present invention provides auxiliary heating equipment for use with a building heating system which fully accomplishes its intended objects and is well adapted to meet practical conditions of manufacture, installation and use.

Although the present invention has been described in some detail by way of illustration and example for purposes of clarity of understanding, it is understood that certain changes and modifications may be made within the spirit of the invention.

What is claimed is:

1. Auxiliary heating equipment for use with a building heating system having a furnace, comprising: an enclosure for spacedly enclosing the furnace to effectively exclude indoor air from combustion, an inlet air duct communicating between said enclosure and the exterior of the building for conducting outside air to said enclosure for supporting combustion in the furnace, an outlet combustion products duct for passing combustion products from said furnace, radiant heating duct means communicating with said outlet combustion products duct for radiating heat to the interior of the building, flue means communicating between said radiant heat duct means and the exterior for exhausting relatively cool flue gas, inlet air valve means in said inlet air duct for opening and closing inlet air duct to the exterior air, valve operating means adapted for connection to the furnace for opening the valve only during furnace operation to prevent heat loss when the furnace is not operating, and a safety air inlet valve in said enclosure for opening the interior of the enclosure to the interior building space upon failure of air supply through the inlet air duct, said safety air inlet comprising a freely swingably depending valve element extending interiorly of and in covering relation with a wall opening of said enclosure, said valve element being swingable inwardly to uncover said wall opening, and weight means carried by said valve element urging the latter closed, whereby a predetermined pressure differential between the interior and exterior of said enclosure is required to open said valve element.

2. Auxiliary heating equipment according to claim 1, said valve means comprising a valve plate extending across and in closing relation with said inlet air duct when oblique to the duct axis, and freely rotative pivot means mounting said valve plate in said inlet air duct for swinging movement about a generally horizontal axis between said oblique closed position and a longitudinal open position, said pivot means being spaced from the center of said valve plate downstream of said air inlet duct for gravitational falling of the upstream region of the valve plate to said oblique closed position, whereby inlet air aids to maintain said valve plate closed.

3. Auxiliary heating equipment according to claim 2, said valve operating means comprising solenoid means operatively connected to said valve plate.

4. Auxiliary heating equipment according to claim 2, said valve plate in said oblique closed position being disposed generally 45° with respect to the inlet air duct longitudinal, for minimizing plate movement to full open position.

5. Auxiliary heating equipment according to claim 1, said weight means comprising a rigid arm outstanding from said valve element, and weight carrying means at a distal region of said arm for carrying a selected amount of weight.

6. Auxiliary heating equipment according to claim 1, said radiant heating duct means comprising a concrete duct embedded in the building floor, and a sump pump in the building floor extending beneath said concrete duct to maintain water level at an elevation below said concrete duct.

7. Auxiliary heating equipment according to claim 6, said concrete radiant heating duct being exposed to space being heated through the building floor, and a plurality of openable closures in the exposed region of said concrete duct.

8. Auxiliary heating equipment according to claim 7, in combination with gas movement means in said flue means for aiding the exhaust flue gas and the inlet of combustion air to the furnace.

* * * * *